US011105137B2

(12) United States Patent
Pleuteri

(10) Patent No.: US 11,105,137 B2
(45) Date of Patent: Aug. 31, 2021

(54) HINGE FOR FURNITURE WITH DEVICE FOR REGULATING THE CLOSING FORCE

(71) Applicant: EFFEGI BREVETTI S.R.L., Segrate (IT)

(72) Inventor: Maurizio Pleuteri, Vignate (IT)

(73) Assignee: EFFEGI BREVETTI S.R.L., Segrate (IT)

( * ) Notice: Subject to any disclaimer, the term of this patent is extended or adjusted under 35 U.S.C. 154(b) by 34 days.

(21) Appl. No.: 16/620,267

(22) PCT Filed: Jun. 5, 2018

(86) PCT No.: PCT/EP2018/064786
§ 371 (c)(1),
(2) Date: Dec. 6, 2019

(87) PCT Pub. No.: WO2018/224505
PCT Pub. Date: Dec. 13, 2018

(65) Prior Publication Data

US 2021/0148149 A1 May 20, 2021

(30) Foreign Application Priority Data

Jun. 7, 2017 (IT) ..... 102017000062317

(51) Int. Cl.
*E05F 1/08* (2006.01)
*E05F 3/20* (2006.01)
(Continued)

(52) U.S. Cl.
CPC ..... *E05F 3/20* (2013.01); *E05D 3/142* (2013.01); *E05D 5/0276* (2013.01); *E05Y 2900/20* (2013.01)

(58) Field of Classification Search
CPC ..... E05Y 2900/20; E05Y 2900/202; E05Y 2900/204; E05Y 2900/208; E05Y 2201/20;
(Continued)

(56) References Cited

U.S. PATENT DOCUMENTS 3,714,680 A * 2/1973 Little ..... F16F 15/067 16/290
4,083,082 A * 4/1978 Holmes ..... E05D 3/142 16/288
(Continued)

FOREIGN PATENT DOCUMENTS

DE 2122857 A1 11/1972
DE 2648085 A1 * 4/1978 ..... E05D 15/46
(Continued)

OTHER PUBLICATIONS

International Search Report and Written Opinion, dated Aug. 20, 2018, from corresponding PCT application No. PCT/EP2018/064786.

*Primary Examiner* — Chuck Y Mah
(74) *Attorney, Agent, or Firm* — Nixon & Vanderhye

(57) ABSTRACT

Hinge for furniture including a fixed part housed in a seat of a horizontal plane of the furniture structure, and a moving part housed in a seat of a door of the furniture, to operate the door in opening and closing by a movement mechanism including at least one lever connecting a pin placed on the fixed part of the hinge and a pin placed on the moving part, wherein the closing force of the door is determined by a spring acting on a pusher that exerts a thrust force on a rocker arm, against which the lever of the door movement mechanism acts, wherein a unit are provided apt to vary the distance of the spring from a pivot pin of the rocker arm, in order to vary the lever arm and consequently the reaction
(Continued)

force of the movement lever and therefore the closing force of the door.

20 Claims, 7 Drawing Sheets

(51) Int. Cl.
*E05D 3/14* (2006.01)
*E05D 5/02* (2006.01)

(58) Field of Classification Search
CPC ..... E05Y 2201/21; E05F 5/006; E05F 5/02; E05F 5/027; E05F 3/20; E05D 3/142; E05D 5/0276; E05D 11/1021; E05D 11/1042; E05D 11/105; E05D 11/1064; E05D 7/04; E05D 7/0407; E05D 7/125; Y10T 16/5383; Y10T 16/304; Y10T 16/54029
See application file for complete search history.

(56) References Cited

U.S. PATENT DOCUMENTS 4,184,228 A * 1/1980 Lautenschlager ..... E05D 3/142 16/294
7,500,287 B2 3/2009 Brüstle
7,810,213 B2 10/2010 Brüstle
8,656,559 B2 * 2/2014 Hung ..... E05D 3/16 16/369
9,719,283 B2 * 8/2017 Holzapfel ..... A47B 96/00
10,294,705 B2 * 5/2019 Hirtsiefer ..... E05D 3/16
10,407,962 B2 * 9/2019 Schluge ..... E05F 1/1058
2001/0039762 A1 11/2001 Giovannetti
2015/0330128 A1 * 11/2015 Ng ..... E05D 7/0407 16/65
2017/0152693 A1 * 6/2017 Chen ..... E05F 5/006

FOREIGN PATENT DOCUMENTS

DE 2818735 A1 * 11/1979 ..... E05D 5/0276
DE 2920156 A1 * 11/1979 ..... E05D 11/1021
DE 2925463 A1 2/1980
DE 3148564 C1 * 4/1983 ..... E05D 11/1021
EP 1154109 A1 11/2001
EP 1728952 A1 * 12/2006 ..... E05D 7/086
GB 2031059 B 8/1982
IT MI20100555 A1 10/2011
WO 2006/005086 A1 1/2006

* cited by examiner

HINGE FOR FURNITURE WITH DEVICE FOR REGULATING THE CLOSING FORCE

BACKGROUND OF THE INVENTION

Field of the Invention

The object of the present invention is a hinge for furniture, such as kitchen furniture and the like, provided with a device for regulating the closing force.

Description of the Related Art

Hinges of the abovementioned type are widely known and, in the case of a vertical door, with side-hinged opening, are placed in the lower part and in the upper part of the furniture item, between the door and the fixed structure.

EP 1154109 describes a device for movement of a door with respect to a fixed structure, comprising a first articulation element restrained to the door and rotating with respect to the fixed structure, a second articulation element hinge-restrained to the fixed structure, the ends of said two articulation elements being hinged together, the first articulation element having an elastically variable extension, so that said two elements can assume one in relation to the other a stable retracted position and a stable extended positioning passing through a succession of unstable positions, and comprising moreover regulation means in order to regulate the distance between an axis of the hinge between the two elements and an axis of rotation of the second element with respect to the fixed structure.

In order to improve aesthetically the side of the furniture item and at the same time remove therefrom the bulk of traditional hinges, there is currently the tendency to use hinges with four pins inserted in the base (lower plane) and in the cover (upper surface or top) of the furniture item.

These hinges have different performances as the weight and dimensions of the doors vary.

The difference in performance is found mainly in the phase of closure of the door, and is accentuated by the presence of dampeners or shock absorbers, which are used to assist during the phase of closure.

Therefore, according to the prior art, these hinges are calibrated on the basis of the door that they have to actuate, so that it is necessary to have in stock components, in particular springs of different elastic force for the different types of doors.

Although providing springs of different force on the basis of the type of door, drops in performance may occur due to wear during the use of the hinge.

BRIEF SUMMARY OF THE INVENTION

The object of the invention is that of eliminating, or at least reducing, the disadvantages of known hinges of the type mentioned above.

More particularly, one object of the invention is that of providing a hinge for furniture which allows a regulation of the closing force, thus allowing a reduction in materials in stock should different doors be used within a range of furniture.

Another object of the invention is that of providing such a hinge that allows an improved optimisation of the function of opening/closure of each door.

Yet another object of the invention is that of providing such a hinge which allows any drops in performance due to wear to be tackled, which may occur during use of the hinge.

A further object of the invention is that of supplying such a hinge for furniture with device for regulating the closing force with a simple and economical design, easy to use.

These and other objects are achieved by the hinge for furniture according to the invention which has the features of the appended independent claim 1.

Advantageous embodiments of the invention are disclosed in the dependent claims.

Substantially, the hinge for furniture according to the invention comprises a fixed part apt to be housed in a seat of a horizontal plane of the structure of the furniture item, such as a base or a top, and a movable part apt to be housed in a seat of a door of the furniture item, in order to actuate the door for opening and closure by means of a movement mechanism comprising at least one lever connecting a pin placed on said fixed part of the hinge and a pin placed on said movable part, wherein the closing force of the door is determined by spring means (20) acting on a pusher that exerts a thrust force on a rocker arm, against which said lever of the door movement mechanism acts, wherein means are provided apt to vary the distance of said spring means from a pivot pin of the rocker arm, in order to vary the lever arm and consequently the reaction force of the movement lever and therefore the closing force of the door, wherein said spring means and said pivot pin are both placed on said fixed part or on said movable part, and wherein said means of regulating the closing force of the door comprise a drawer housing said spring means and pusher, which can translate to move towards and away from said pivot pin of the rocker arm.

BRIEF DESCRIPTION OF THE DRAWINGS

Further features of the invention will be made clearer by the following detailed description, referred to one of its embodiments purely by way of a non-limiting example, illustrated in the accompanying drawings, in which.

DETAILED DESCRIPTION OF THE PREFERRED EMBODIMENTS

Figure 3:
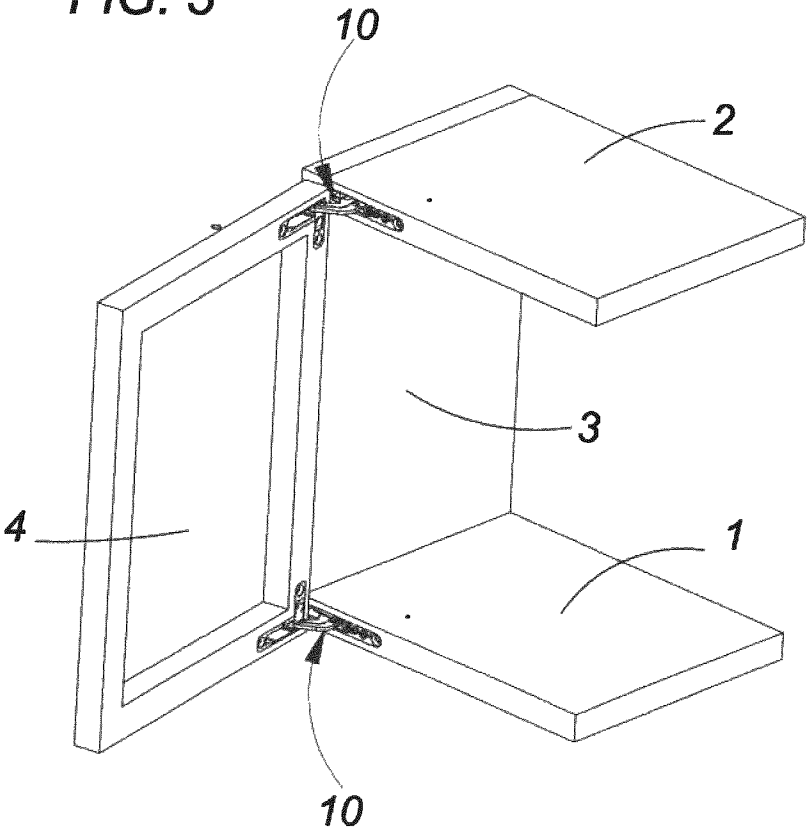
FIG. 3 shows a portion of a furniture item with door, wherein hinges according to the invention are used.

FIG. 3 shows schematically a portion of furniture sufficient for illustrating the positioning and the functioning of the hinge according to the invention. More particularly, a base surface 1 is shown, an upper surface or top 2 connected to a side wall 3, and a door 4.

The door 4 can be opened in a side-hinged manner with respect to the structure of the furniture item, by means of a pair of hinges 10 acting between the door itself and said base 1 and cover 2 surfaces.

Naturally a hinge 10 can also be provided between the door 4 and an intermediate plane (not shown) securely fixed to the structure of the furniture item.

Figure 2:
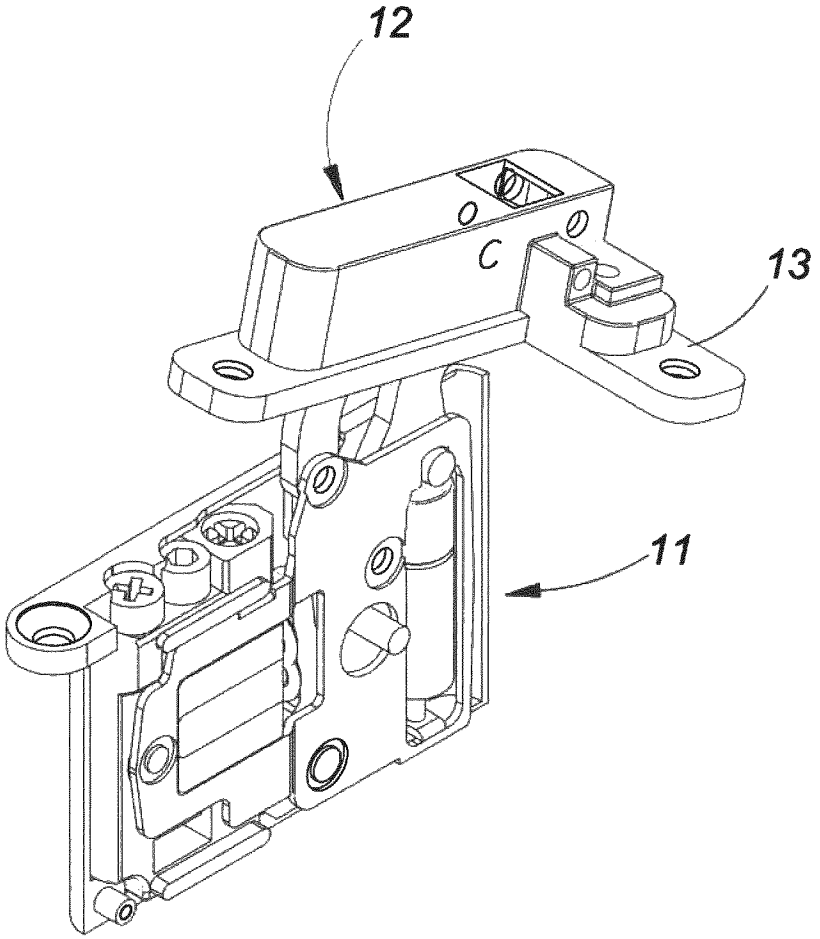
FIGS. 1 and 2 are axonometric views of a hinge according to a first embodiment of the invention, shown in position of closure and of opening of a door, respectively.
Figure 1:
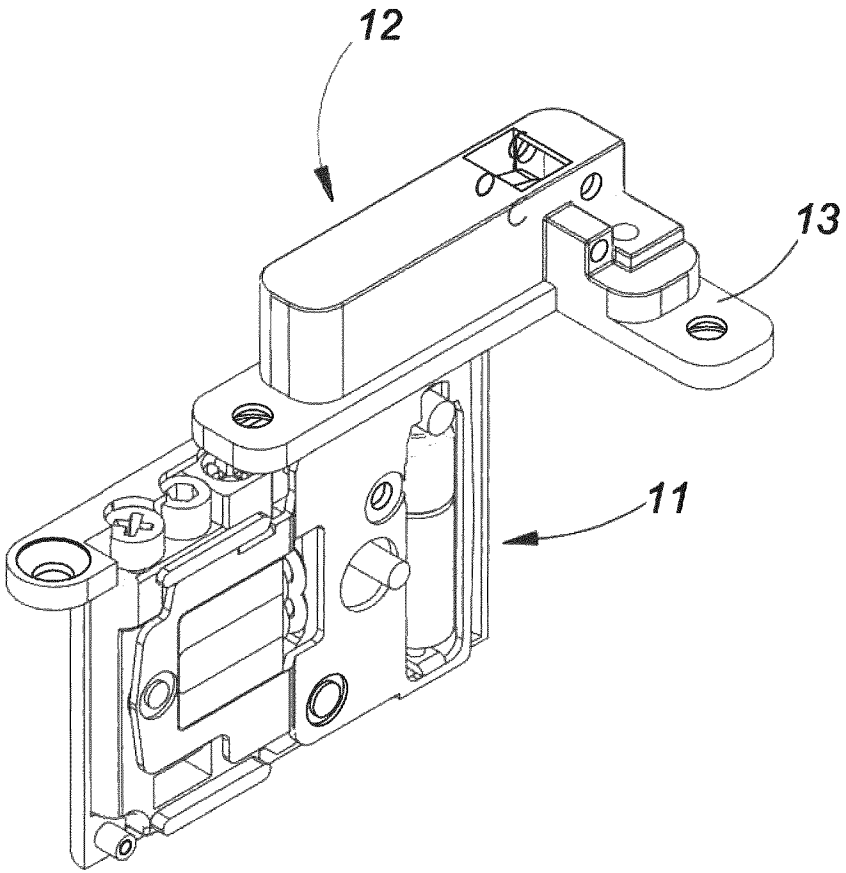
Figure 4:
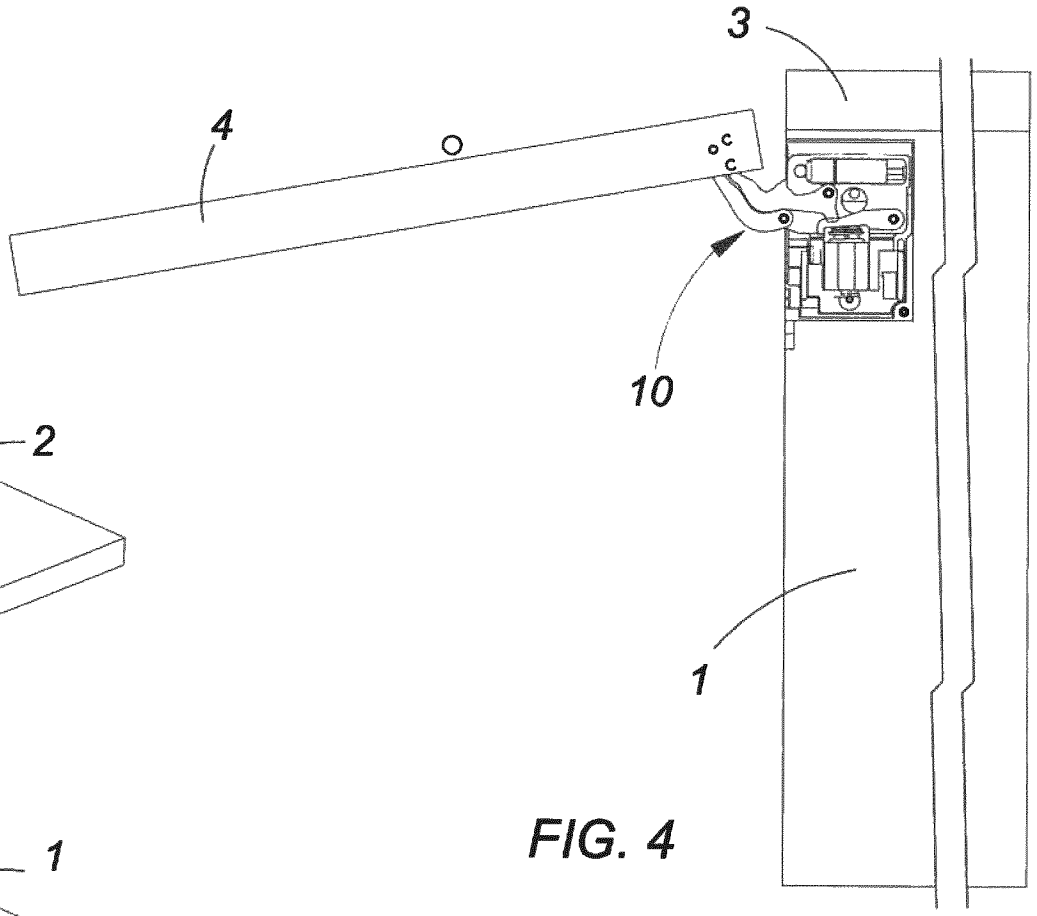
FIG. 4 is a horizontal section taken at one of the hinges, for example the lower one, of FIG. 3.

The hinge 10, whose structure is shown in FIGS. 1 and 2, comprises a part 11 which is to be inserted in a seat of a horizontal plane 1, 2 of the furniture item, and a part 12 which is inserted instead in a seat of the vertical door 4.

The part 12 of the hinge is made in two different configurations, with a section 13 which is oriented upwards or downwards, according to whether the hinge is placed at the base 1 or top 2 of the furniture item, as shown in FIG. 3.

The hinge 10 according to the first embodiment of the invention is now described with reference to the plan views of FIGS. 5 and 6 of the section view of FIG. 7, which better shows the structure of the device for regulation of the closing force.

The hinge 10 is of the so-called type with four pins 14 and 15, 16 and 17, whereto a pair of levers or arms 18, 19 are restrained respectively, which accompany the door 4, by means of the hinge part or block 12, during the movement of opening and closure.

The closing force of the door 4 is determined by a spring 20 which, by means of a pusher 21, exerts a thrust on a rocker arm 22 pivoted in 23 in the low part of the hinge part 11, against which rocker arm 22, in proximity of its free end, the lever arm 18 of the door actuation mechanism acts.

The greater the distance of the spring 20 from the pivot 23, the greater the reaction force of the lever arm 18, and therefore the closing force of the door.

In order to soften the movement of closure a shock absorber or dampener is also provided 30, placed approximately parallel to the rocker arm 22 and acting in an intermediate section of the lever arm 18, between the pin 14 provided on the fixed part 11 of the hinge and the pin 15 provided on the movable part 12.

According to the invention the spring 20 and the pusher 21 are housed in a drawer 24, having a side projection 25, threaded internally, with which a screw 26 engages, the rotation whereof in one direction or in the other produces a translation of the drawer 24 determining a movement towards or away of the pusher 21 of the pivot pin 23 of the rocker arm 22, with consequent variation of the lever arm.

Figure 5:
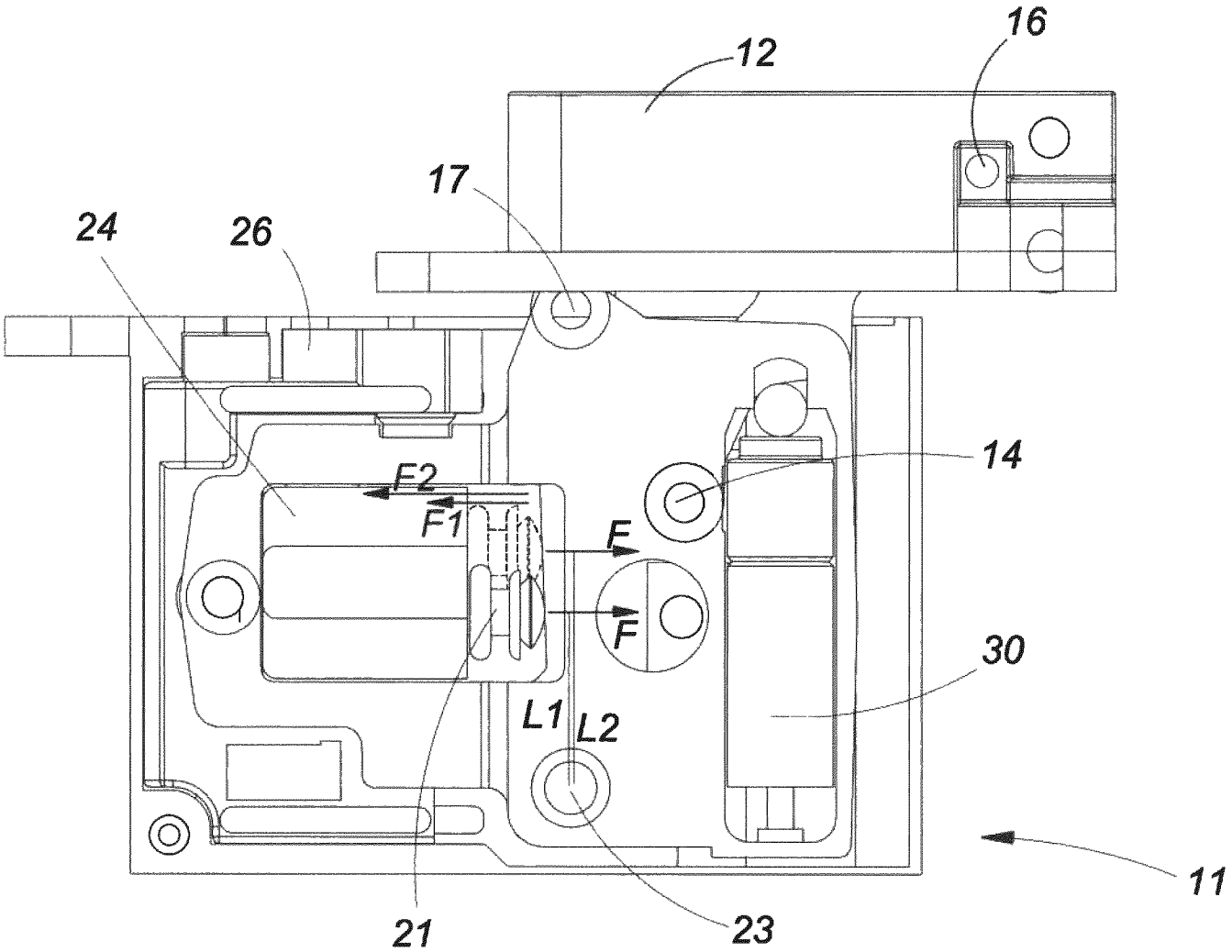
FIGS. 5 and 6 are schematic plan views like that of FIG. 4, showing the components of the hinge respectively in the configuration of closure and of (partial) opening of the door.
Figure 6:
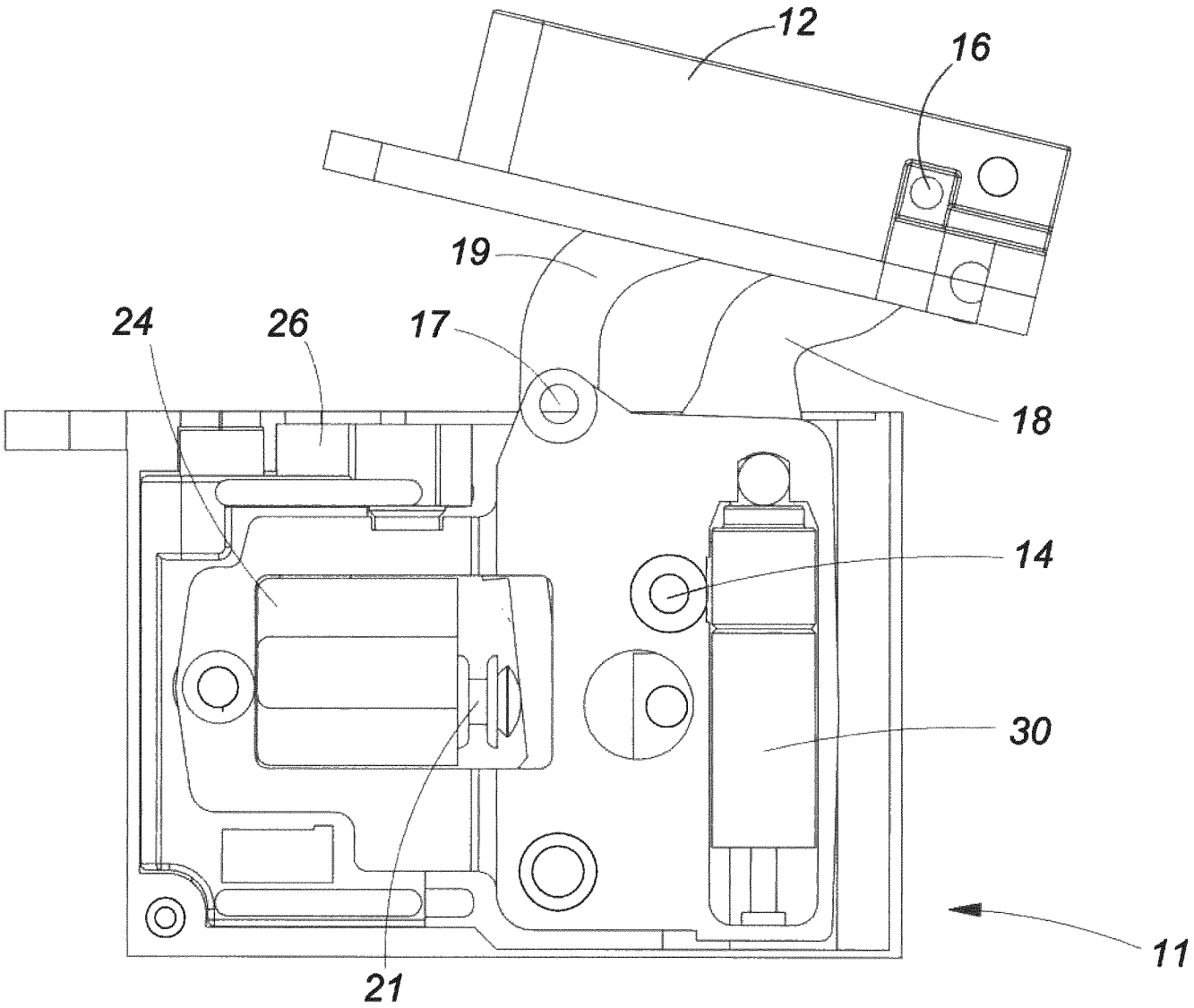
Figure 7:
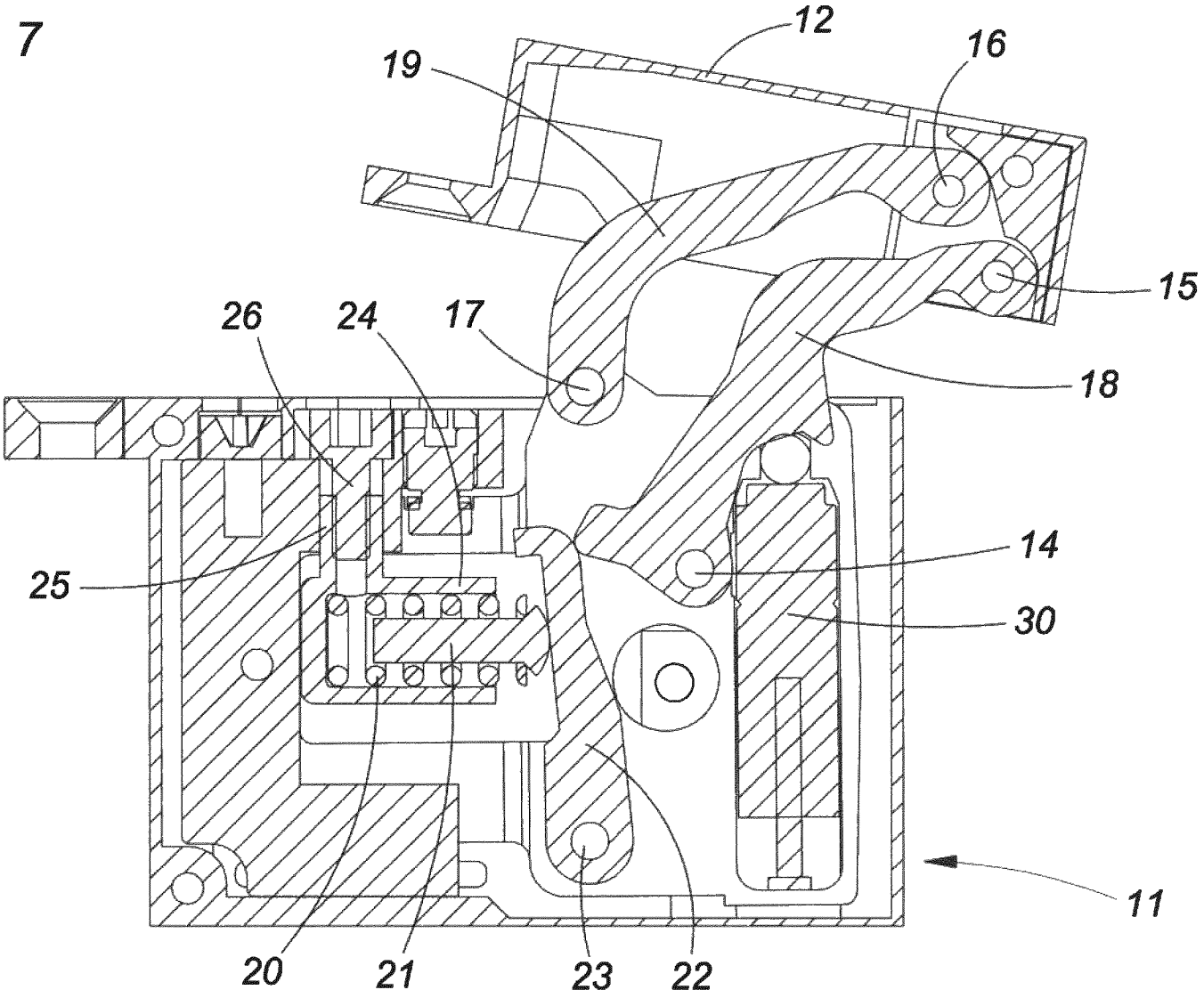
FIG. 7 is a section view of the hinge of FIG. 6 showing in greater detail the device for regulation of the closing force.

The situation is shown more clearly in FIGS. 5 and 6, where the pusher 21 is shown in two different positions, with unbroken and dotted lines respectively.

In the position with unbroken lines, the force F of the spring 20 acts with an arm L1 on the rocker arm 22, creating a reaction F1 on the arm 18 of the mechanism for actuation of the door 4, forcing the arm 18 to bring the door into closure with this force F1.

Acting on the screw 26 in the direction of screwing, in order to translate the drawer 24 upwards and bring the pusher 21 into the position shown with dotted lines, the lever arm increases from L1 to L2, so that the same force F of the spring 20 produces a greater reaction F2 on the arm 18, with a consequent greater closing force of the door.

Figure 8:
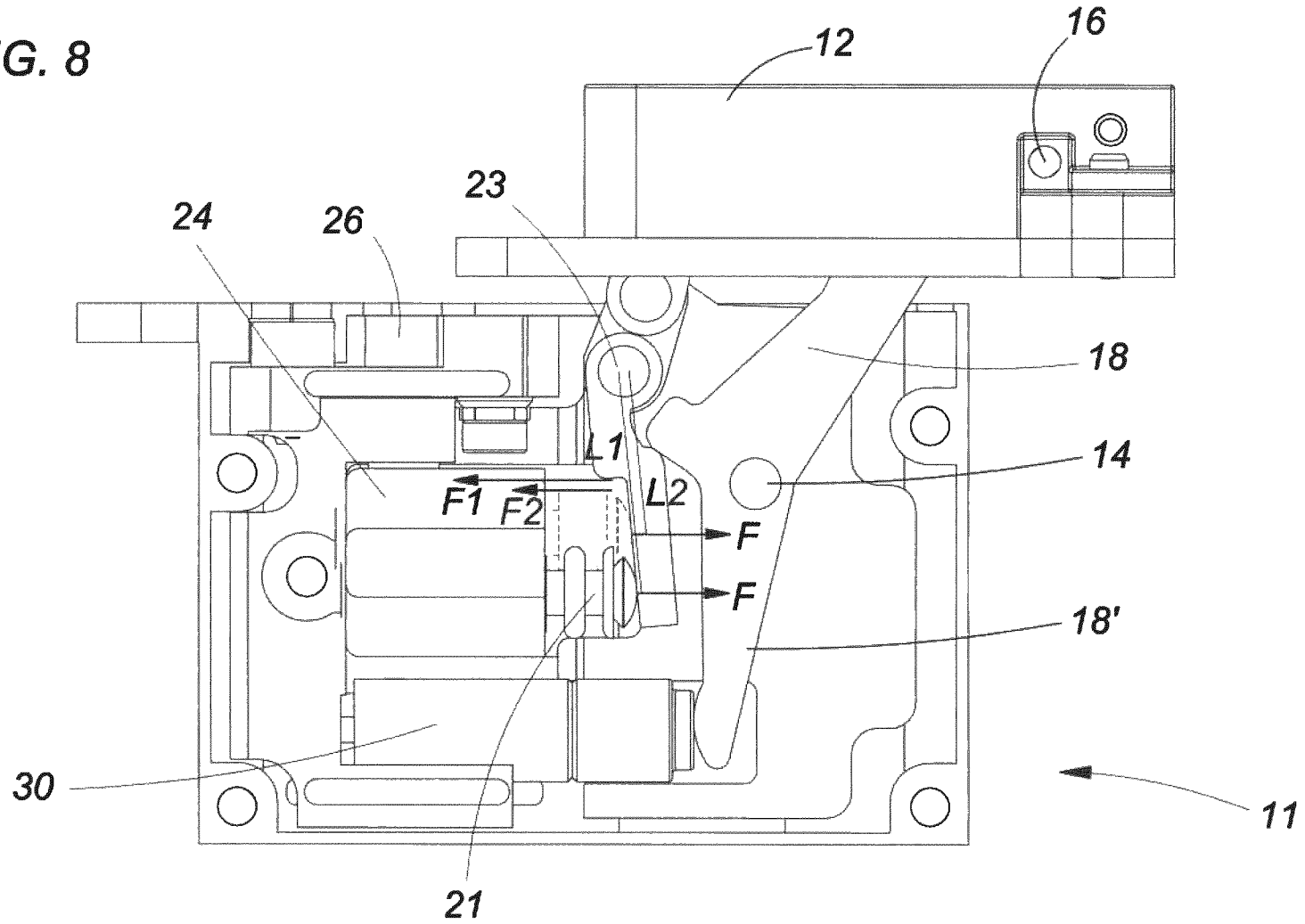
FIGS. 8 and 9 are views similar to FIGS. 5 and 6, respectively, showing a second embodiment of the hinge according to the invention.
Figure 9:
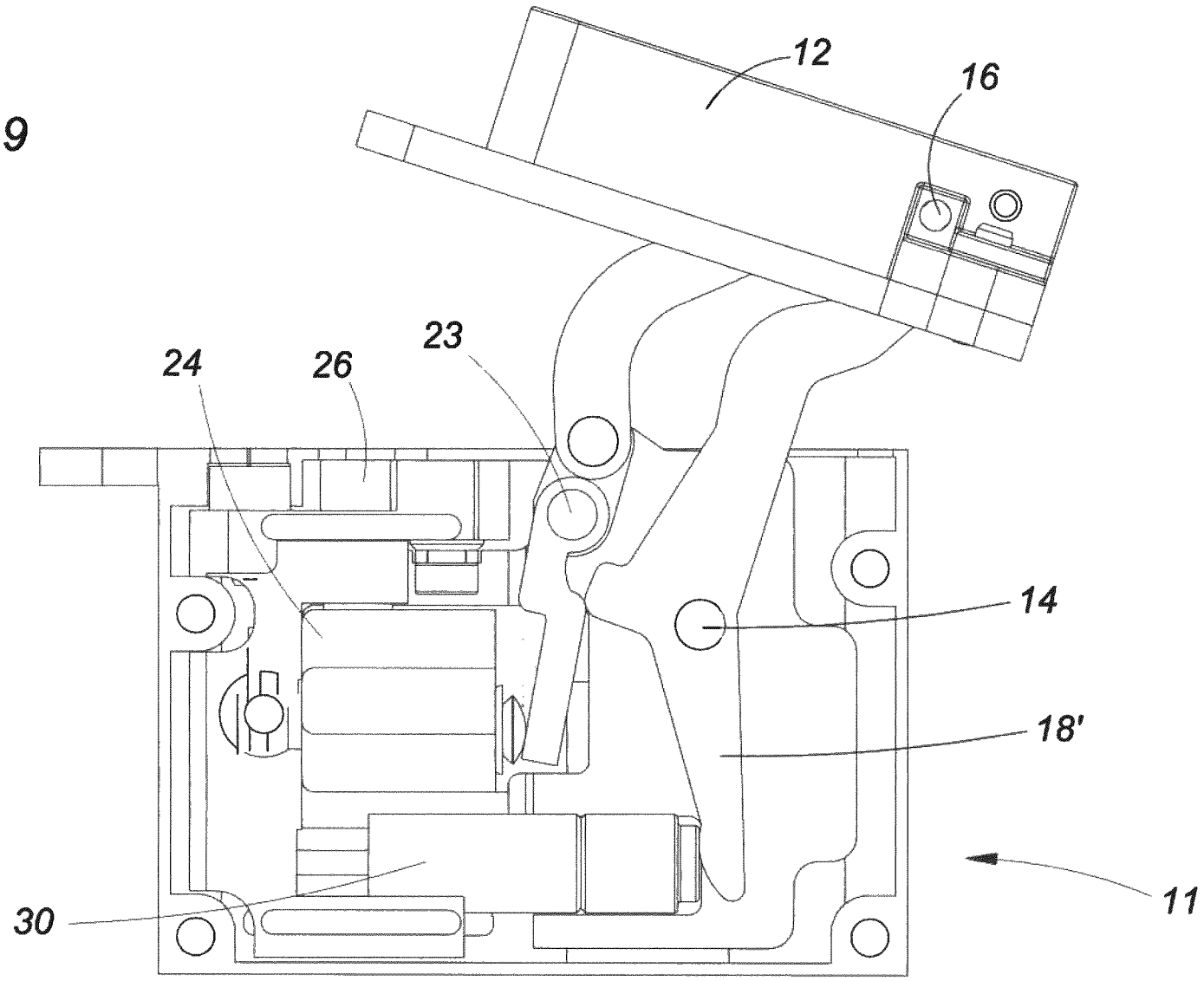

FIGS. 8 and 9 show a second embodiment of a hinge with device for regulation of the closing force of a door according to the invention.

This hinge of the second embodiment differs from the embodiment described previously only in the arrangement and configuration of some component parts, which will be denoted by the same reference numerals used previously.

Substantially, in this case the shock absorber or dampener 30 is placed virtually parallel to the spring 20, and therefore substantially perpendicular to the rocker arm 22, and acts on an extension 18', on the opposite side with respect to the pivot pin 14, of the movement lever 18.

Consequently, the position of the rocker arm 22 is inverted with respect to the preceding embodiment, with the pivot pin 23 placed in the upper part, rather than in the lower part of the hinge part 11.

In this case, in order to increase the closing force, it is necessary to act on the screw 26 in order to translate downwards the drawer 24 in order to distance it from the pivot pin 23 and increase the lever arm from L1 to L2 and therefore the reaction force of the lever 18 from F1 to F2.

The hinge 10, 10' with the regulation device according to the invention can compensate the differences of force necessary, as a function of the dimensions and of the weight of the doors attached to the furniture item.

Likewise, any drops in performance due to the wear during use of the hinge can be compensated, by means of a simple regulation screw 26, which acts on the drawer 24 carrying the spring 20.

Although in the preceding description there was mention of a spring 20, it is clear that a group of springs acting on the rocker arm 22 can be provided.

Naturally the invention is not limited to the particular embodiments described previously and illustrated in the accompanying drawings, but numerous detail changes may be made thereto, within the reach of the person skilled in the art, without thereby departing from the scope of the same invention, as defined in the appended claims.

The invention claimed is:

1. A hinge for furniture comprising:

a fixed part (11) apt to be housed in a seat of a horizontal plane of the furniture structure, such as a base (1) or a top (2), and a moving part (12) apt to be housed in a seat of a door (4) of the furniture, in order to operate the door in opening and closing by means of a movement mechanism comprising at least one lever (18) connecting a pin (14) placed on said fixed part (11) of the hinge and a pin (15) placed on said moving part (12), wherein a closing force of the door is determined by spring means (20) acting on a pusher (21) that exerts a thrust force on a rocker arm (22), against the rocker arm (22) said at least one lever (18) of the door movement mechanism acts, the hinge comprising means apt to vary the distance of said spring means (20) from a pivot pin (23) of the rocker arm (22), in order to vary the lever arm and consequently the reaction force of the at least one lever (18) and therefore the closing force of the door, wherein said spring means (20) and said pivot pin (23) are both placed on said fixed part (11) or on said movable part (12), and wherein means of regulating the closing force of the door comprise a drawer (24) housing said spring means (20) and the pusher (21), which can translate to move towards and away from said pivot pin (23) of the rocker arm (20).

2. The hinge according to claim 1, wherein screw means (26) are provided to move in translation said drawer (24).

3. The hinge according to claim 2, wherein said drawer (24) has an internally threaded projection (25), wherein said screw means (26), accessible from the outside of the fixed part (11) of the hinge, engage.

4. The hinge according to claim 3, further comprising a shock absorber (30) acting against said at least one lever (18) in order to soften the closing movement thereof.

5. The hinge (10) according to claim 3, wherein said pivot pin (23) of the rocker arm (22) is arranged relative to the pusher (21) on the opposite side with respect to said screw means (26), said at least one lever (18) for actuation of the door (4) acting close to a free end of the rocker arm (22).

6. The hinge according to claim 3, wherein said pin (23) of the rocker arm (22) is situated between said screw means (26) and said pusher (21), the at least one lever (18) acting on the rocker arm (22) in a point between said pivot pin (23) and said pusher (21).

7. The hinge according to claim 3, wherein the at least one lever comprises a first lever (18) and a second lever (19), and said door movement mechanism further comprises four pins (14, 15 and 16, 17) connecting the first and second levers (18, 19) between said fixed (11) and moving (12) parts of the hinge.

8. The hinge according to claim 2, further comprising a shock absorber (30) acting against said at least one lever (18) in order to soften the closing movement thereof.

9. The hinge (10) according to claim 2, wherein said pivot pin (23) of the rocker arm (22) is arranged relative to the pusher (21) on the opposite side with respect to said screw means (26), said at least one lever (18) for actuation of the door (4) acting close to a free end of the rocker arm (22).

10. The hinge (10') according to claim 2, wherein said pin (23) of the rocker arm (22) is situated between said screw means (26) and said pusher (21), the at least one lever (18) acting on the rocker arm (22) in a point between said pivot pin (23) and said pusher (21).

11. The hinge according to claim 2, wherein the at least one lever comprises a first lever (18) and a second lever (19), and said door movement mechanism further comprises four pins (14, 15 and 16, 17) connecting the first and second levers (18, 19) between said fixed (11) and moving (12) parts of the hinge.

12. The hinge according to claim 1, further comprising a shock absorber (30) acting against said at least one lever (18) in order to soften the closing movement thereof.

13. The hinge (10) according to claim 12, wherein said pivot pin (23) of the rocker arm (22) is arranged relative to the pusher (21) on the opposite side with respect to screw means (26), said at least one lever (18) for actuation of the door (4) acting close to a free end of the rocker arm (22).

14. The hinge (10) according to claim 13, wherein said shock absorber (30) acts in an intermediate zone of the at least one lever (18) between said pins (14, 15).

15. The hinge according to claim 14, wherein the at least one lever comprises a first lever (18) and a second lever (19), and said door movement mechanism further comprises four pins (14, 15 and 16, 17) connecting the first and second levers (18, 19) between said fixed (11) and moving (12) parts of the hinge.

16. The hinge according to claim 13, wherein the at least one lever comprises a first lever (18) and a second lever (19), and said door movement mechanism further comprises four pins (14, 15 and 16, 17) connecting the first and second levers (18, 19) between said fixed (11) and moving (12) parts of the hinge.

17. The hinge according to claim 12, wherein said pin (23) of the rocker arm (22) is situated between screw means (26) and said pusher (21), the at least one lever (18) acting on the rocker arm (22) in a point between said pivot pin (23) and said pusher (21).

18. The hinge according to claim 17, wherein said shock absorber (30) acts on an extension (18') of said at least one lever (18) past said pivot pin (14) situated on the fixed part (11) of the hinge constrained to a plane (1, 2) of the furniture.

19. The hinge according to claim 12, wherein the at least one lever comprises a first lever (18) and a second lever (19), and said door movement mechanism further comprises four pins (14, 15 and 16, 17) connecting the first and second levers (18, 19) between said fixed (11) and moving (12) parts of the hinge.

20. The hinge according to claim 1, wherein the at least one lever comprises a first lever (18) and a second lever (19), and said door movement mechanism further comprises four pins (14, 15 and 16, 17) connecting the first and second levers (18, 19) between said fixed (11) and moving (12) parts of the hinge.

* * * * *